US011166107B1

(12) United States Patent
Scheek et al.

(10) Patent No.: US 11,166,107 B1
(45) Date of Patent: Nov. 2, 2021

(54) SPEAKER UNIT WITH A SPEAKER FRAME AND TWO OPPOSING SOUND PRODUCING MEMBRANES

(71) Applicant: Mayht Holding B.V., Nieuw-Vennep (NL)

(72) Inventors: Timothy Ruben Scheek, Rotterdam (NL); Mattias Jeffrey Scheek, Amsterdam (NL)

(73) Assignee: Mayht Holding B.V., Nieuw-Vennep (NL)

( * ) Notice: Subject to any disclaimer, the term of this patent is extended or adjusted under 35 U.S.C. 154(b) by 0 days.

(21) Appl. No.: 17/088,624

(22) Filed: Nov. 4, 2020

(51) Int. Cl.
*H04R 9/06* (2006.01)
*H04R 9/04* (2006.01)

(52) U.S. Cl.
CPC ..... *H04R 9/063* (2013.01); *H04R 9/043* (2013.01); *H04R 2400/07* (2013.01)

(58) Field of Classification Search
CPC .... H04R 9/063; H04R 9/043; H04R 2400/07; H04R 2231/003; H04R 2307/00; H04R 2307/201; H04R 7/12; H04R 7/20; H04R 1/22; H04R 2207/00; H04R 7/16; H04R 7/18; H04R 2400/11
See application file for complete search history.

(56) References Cited

U.S. PATENT DOCUMENTS

2007/0194635 A1* 8/2007 Miura ..... B06B 1/045 310/15
2010/0172535 A1* 7/2010 Huang ..... H04R 7/20 381/404
2011/0075880 A1* 3/2011 Kamimura ..... H04R 9/10 381/413
2012/0106775 A1* 5/2012 Shao ..... H04R 9/043 381/412
2020/0186928 A1* 6/2020 Sancisi ..... H04R 7/20
2020/0296502 A1* 9/2020 Scheek ..... H04R 1/2873
2020/0344554 A1* 10/2020 Scheek ..... H04R 9/063

FOREIGN PATENT DOCUMENTS

WO WO-2019086357 A1 * 5/2019 ..... H04R 7/04
WO WO-2019117706 A1 * 6/2019 ..... H04R 9/043

* cited by examiner

*Primary Examiner* — Mark Fischer
(74) *Attorney, Agent, or Firm* — N.V. Nederlandsch Octrooibureau; Catherine A. Shultz; Katelyn J. Bernier

(57) ABSTRACT

A speaker unit includes a speaker frame and two opposing membranes each being arranged to move up and down along a main speaker axis (A). Two drive units are present for each membrane, having a driver static part and a driver moving part. A sealing edge suspension is connected to a perimeter of the associated membrane and to the major front surface and major back surface of the speaker unit, respectively. For each driver moving part, a spider arm suspension is present for suspending the driver moving part to the speaker frame in a flexible manner. The sealing edge suspension is at least partially positioned above the associated drive units when viewed in a direction parallel to the main speaker axis (A).

19 Claims, 5 Drawing Sheets

SPEAKER UNIT WITH A SPEAKER FRAME AND TWO OPPOSING SOUND PRODUCING MEMBRANES

FIELD OF THE INVENTION

Figure 1:
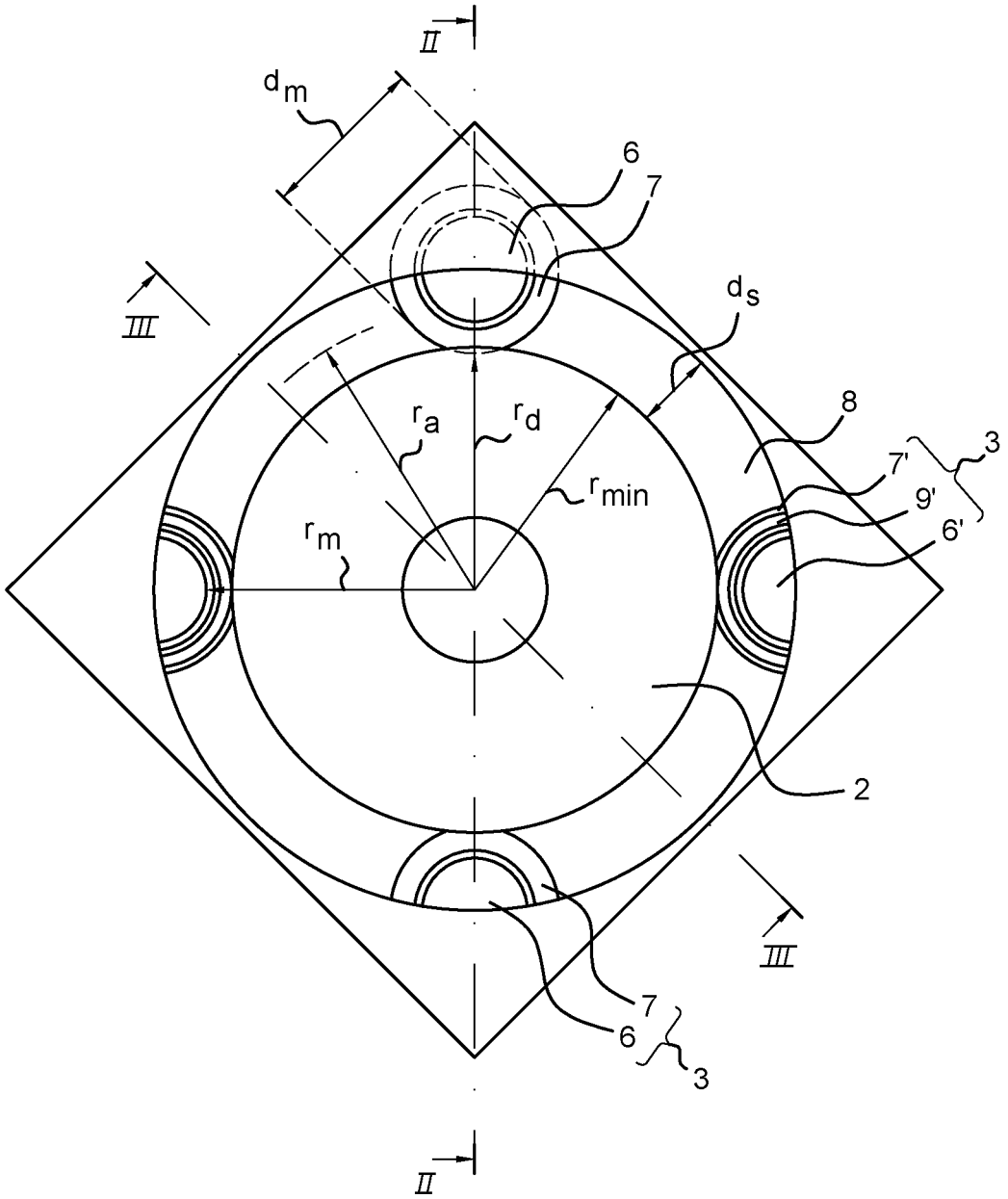

The present invention relates to a speaker unit.

BACKGROUND

Speaker units are well known in the prior art, such as speaker transducers comprising a cone shape speaker membrane and a membrane driver or actuator coaxially arranged with respect to the speaker membrane at a back side thereof. Planar type speaker units are also known in the art, wherein the speaker transducer comprise a planar speaker membrane and a plurality of membrane drivers arranged along a surface of the speaker membrane. Although the well-known coaxial cone shaped speaker transducers allow for high performance and fidelity, they are less suitable for smaller loud speaker systems due to the coaxial arrangement of the speaker membrane and membrane driver. Planar type speaker transducers do allow for flatter loudspeaker designs because of the substantially flat speaker membrane.

International patent publication WO2019/117706 discloses a speaker device having a frame, two opposite directed diaphragms, and two speaker drivers, each having at least one magnetic driver for driving the two opposite directed diaphragms in operation. A speaker damper is associated with each of the two opposite directed diaphragms, and has a coil bracket arranged to be driven by the associated at least one magnetic driver, a diaphragm connection member arranged to fixedly attach the diaphragm to the speaker damper, and a damper frame connection member arranged to fixate the speaker damper to the frame. The speaker damper further comprises a damper leg member arranged between the diaphragm connection member and the damper frame connection member.

SUMMARY

The present invention seeks to provide a speaker unit having small dimensions, yet provides a linear response characteristic.

A speaker unit is provided which includes a speaker frame with a major front surface and a major back surface, two opposing (sound producing) membranes arranged in the major front surface and the major back surface, respectively, each being arranged to move up and down along a main speaker axis (perpendicular to major front and back surfaces of speaker). At least two drive units are provided for each of the two opposing membranes, each drive unit comprising a driver static part and a driver moving part, the driver moving part being fixedly connected to the associated one of the two opposing membranes. Each of the two opposing membranes are provided with a sealing edge suspension connected to a perimeter of the associated membrane and to the major front surface and major back surface, respectively, further comprising, for each driver moving part, a spider arm suspension connected on one side to the associated driver moving part and on another side to the speaker frame for suspending the driver moving part to the speaker frame in a flexible manner, wherein the sealing edge suspension is at least partially positioned above the associated drive units when viewed in a direction parallel to the main speaker axis. This positioning of the sealing edge suspension relative to the drive unit, and the associated spider arm suspension, allows the two opposing membranes to move along the main speaker axis without any chance of interference or blocking by other (internal) components of the speaker unit.

SHORT DESCRIPTION OF DRAWINGS

Figure 2A:
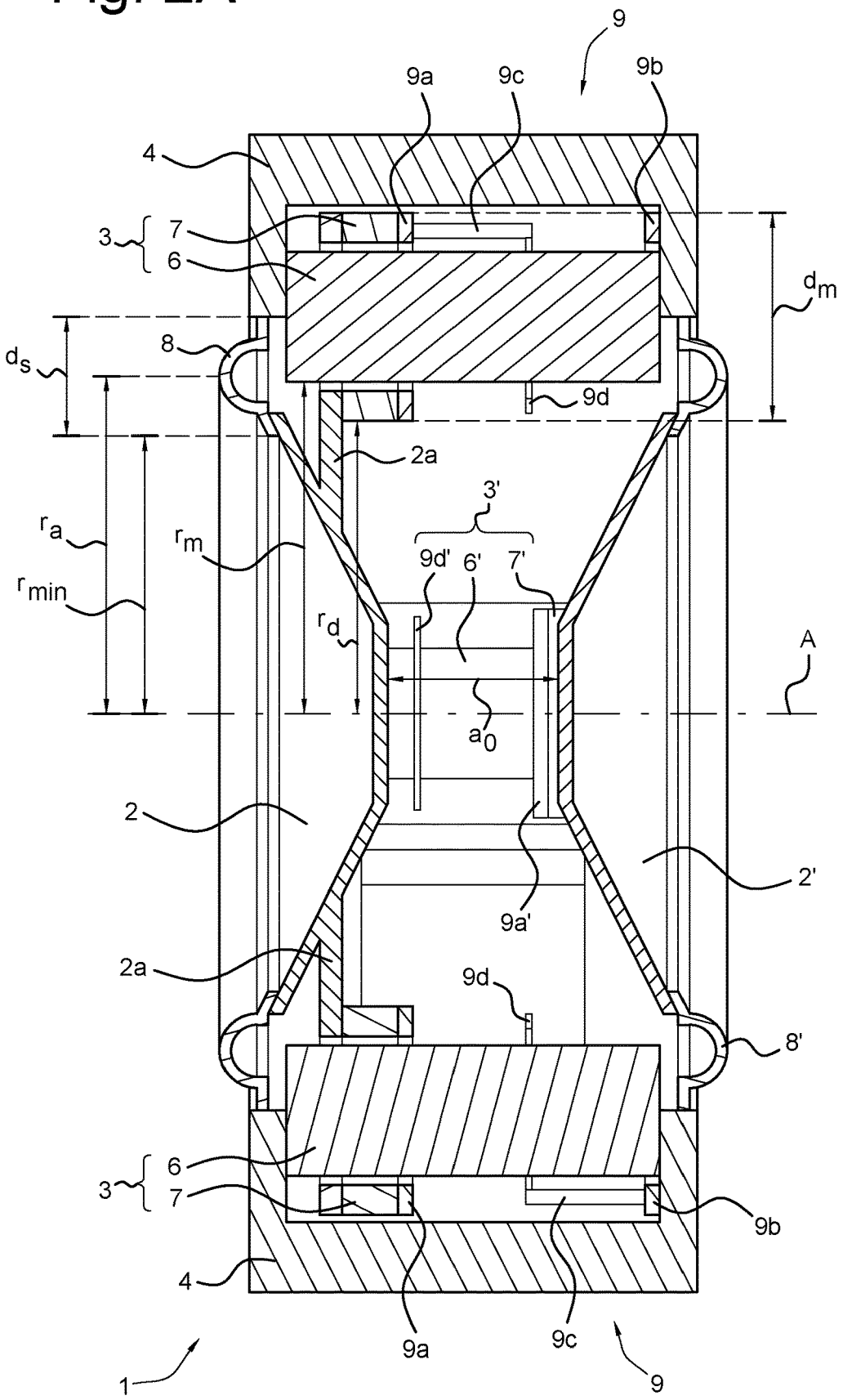
Figure 2B:
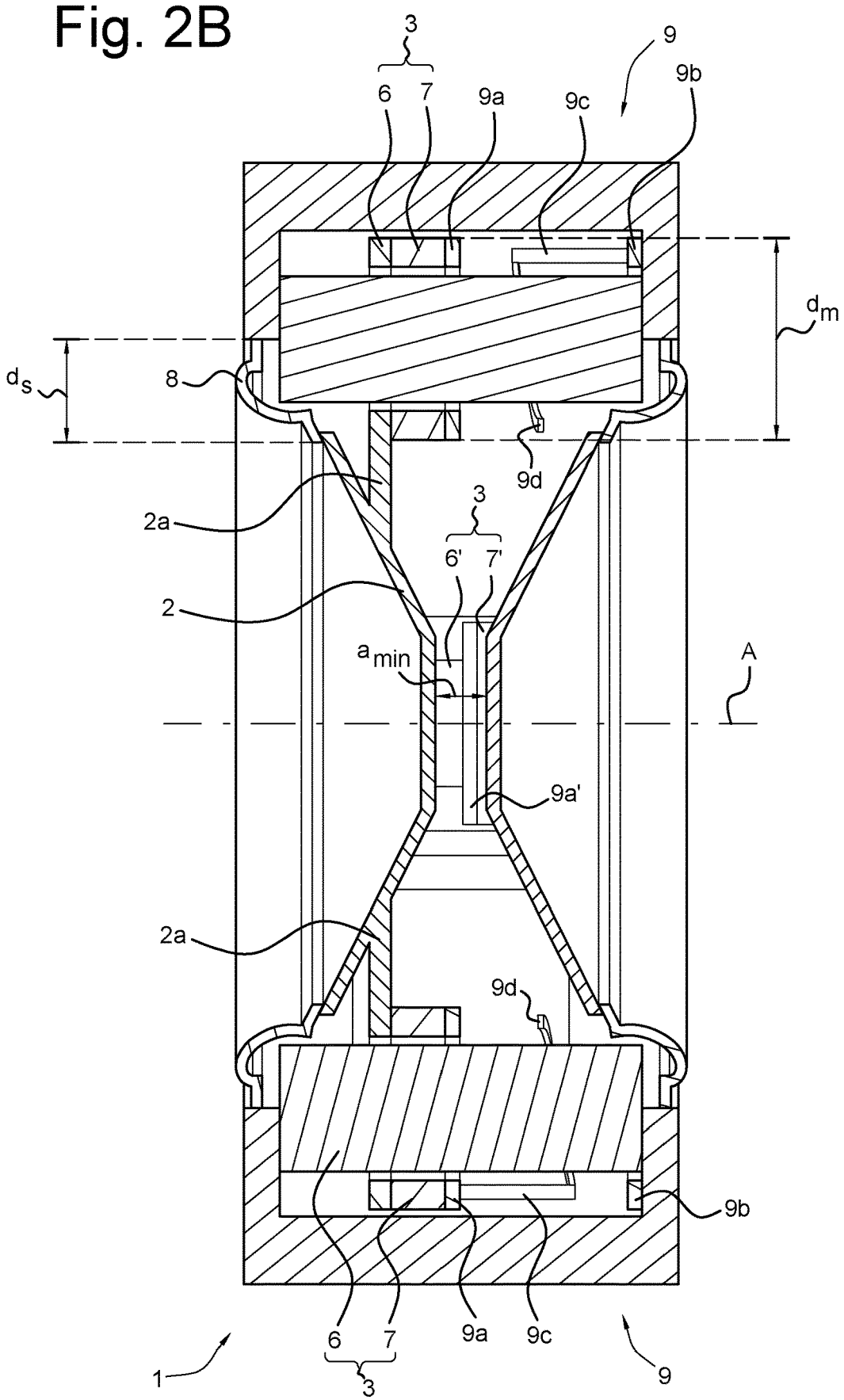
Figure 3A:
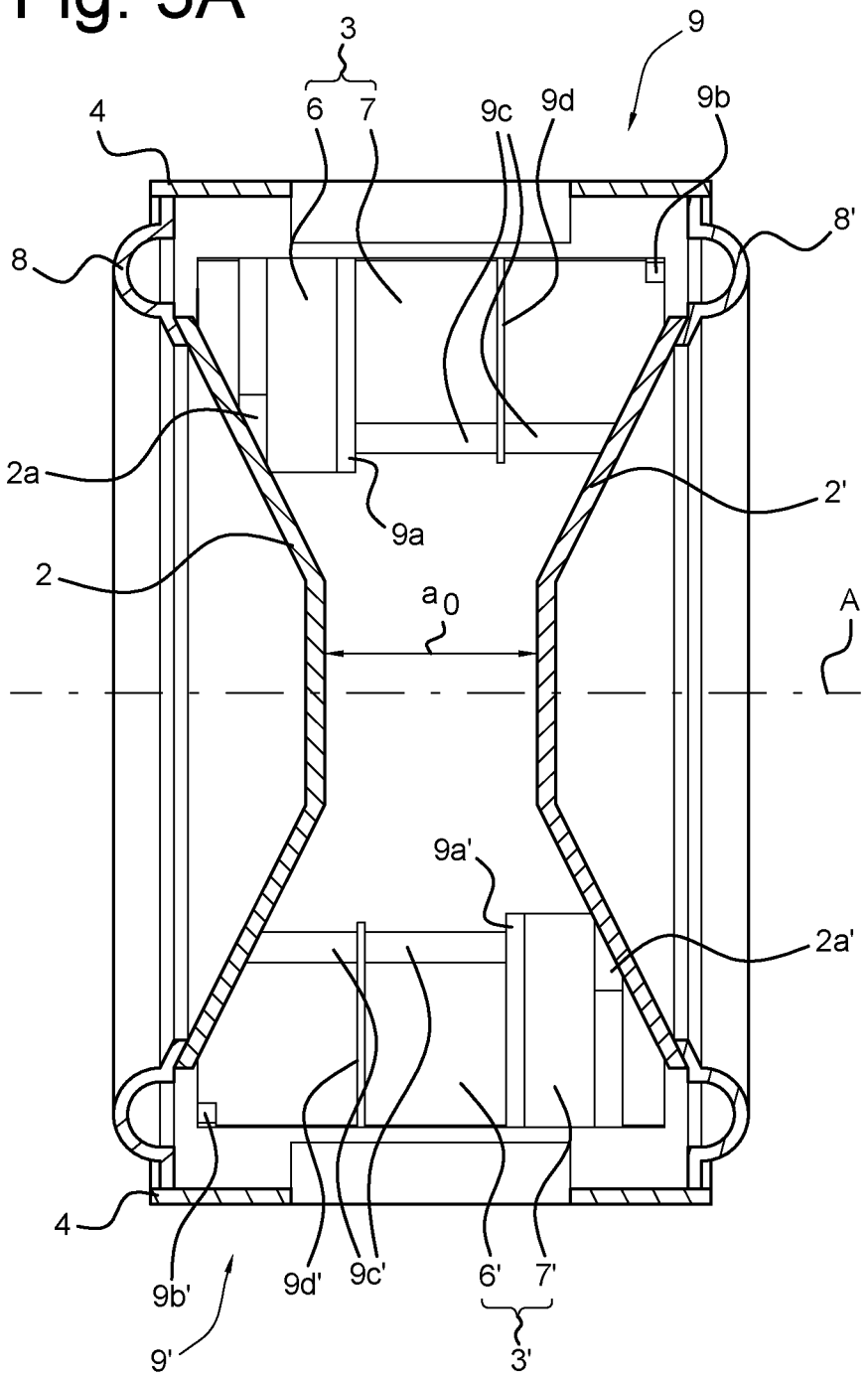
Figure 3B:
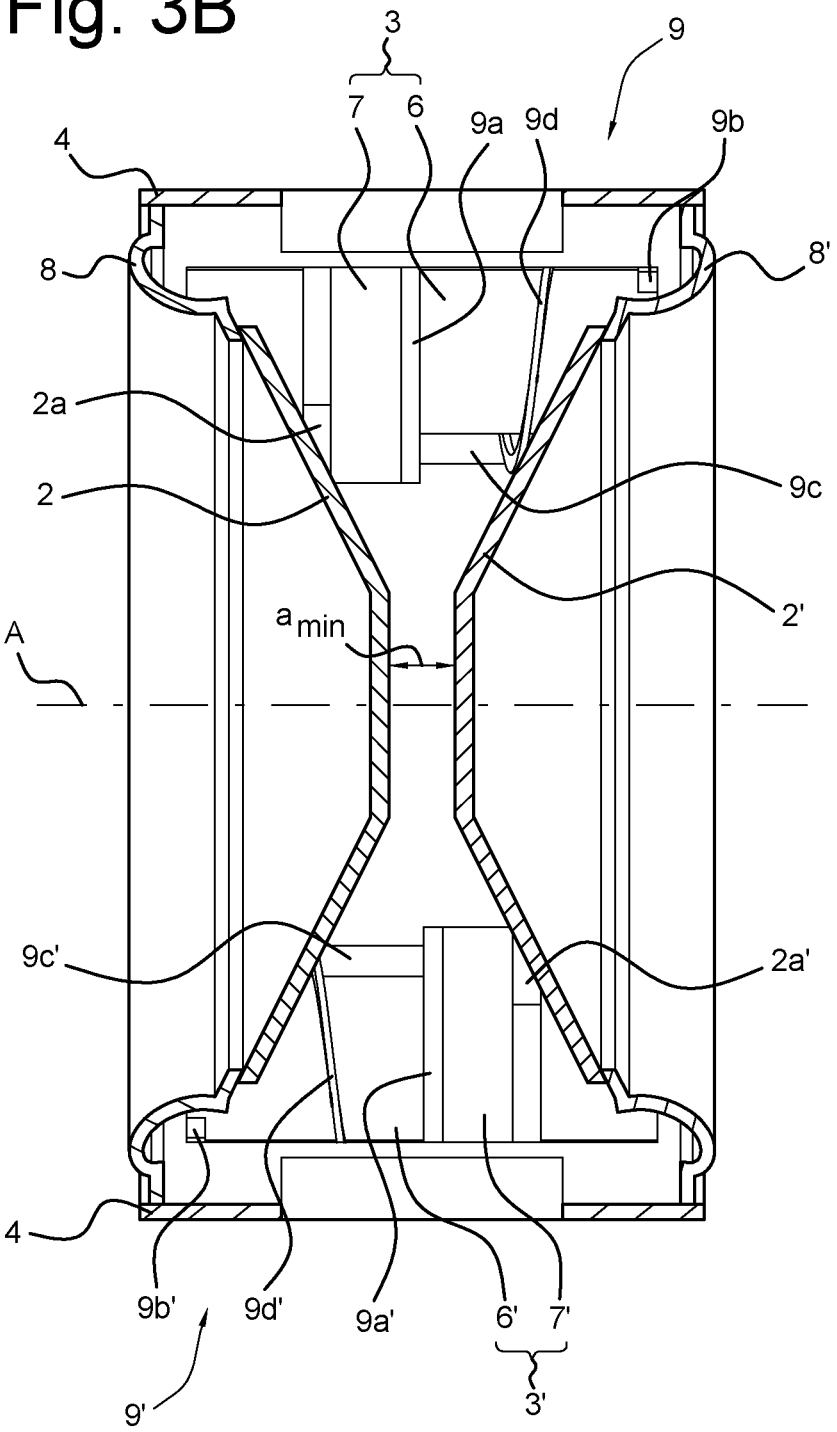

The present invention will be discussed in more detail below, with reference to the attached drawings, in which FIG. 1 shows a top projection view of the speaker unit according to an embodiment of the present invention;

FIGS. 2A and 2B show a cross sectional view of a speaker unit according to an embodiment of the present invention, FIG. 2A showing an at rest position of the speaker unit, and FIG. 2B showing the situation where the two membranes are closest to each other (inward excursion of both membranes);

FIGS. 3A and 3B a cross sectional view of the embodiments shown in FIGS. 2A and 2B, respectively, rotated over 45 degrees, along the line III-III in FIG. 1.

DESCRIPTION OF EMBODIMENTS

The present invention embodiments relate to a loudspeaker unit having an improved compactness of architecture using a dual membrane driver architecture, while keeping the membrane movement as linear as possible. Such loudspeaker unit could be a speaker device as described in the international patent publication WO2019/117706, filed 24 Apr. 2018 and titled Distributed Transducer Suspension Cones (DTSC), of the same inventors as the present application, which is incorporated herein by reference.

For improved linearity and air tight sealing a second suspension element is provided in embodiments, as discussed in detail below with reference to a particular embodiment. The arrangement of the membranes 2, 2', drive units 3, 3' and suspension components allow free movement of the membranes 2, 2' without collisions with any internal speaker unit components.

FIGS. 2A and 2B show a cross sectional view of a speaker unit 1 according to an embodiment, FIG. 2A showing an 'at rest' position of the speaker unit, and FIG. 2B showing the situation where the two membranes 2, 2' are closest to each other (inward excursion of both membranes 2, 2'. The cross section is across a diagonal of the speaker unit 1, as shown in FIG. 1 as lines II-II, showing that in this embodiment, two drive units 3 are provided for driving membrane 2, while only one drive unit 3' is visible which drives the other membrane 2'.

The speaker unit 1 has a speaker frame 4 with a major front surface and a major back surface, and two opposing (sound producing) membranes 2, 2' arranged in the major front surface and the major back surface, respectively, each being arranged to move up and down along a main speaker axis A. The major speaker axis in this embodiment is perpendicular to the major front and back surfaces of the speaker unit 1. At least two drive units 3, 3' for each of the two opposing membranes 2, 2' are provided, each drive unit 3, 3' comprising a driver static part (in this embodiment a magnet stack 6, 6') and a driver moving part (in this embodiment a voice coil 7, 7'), the driver moving part 7, 7' being fixedly connected to the associated one of the two opposing membranes 2, 2' (e.g. using a connection member 2*a* as shown in the embodiments in FIGS. 2A and 2B). Each of the two opposing membranes 2, 2' are provided with a sealing edge suspension 8, 8' connected to a perimeter of the associated membrane 2, 2' and to the major front surface and major back surface, respectively. For each driver moving part 7, 7', a spider arm suspension 9, 9' is connected on one side to the associated driver moving part 7, 7' and on another side to the speaker frame 4 for suspending the driver moving part 7, 7' to the speaker frame 4 in a flexible manner.

In some embodiments, the sealing edge suspension 8, 8' is at least partially positioned above the associated drive units 3, 3' when viewed in a direction parallel to the main speaker axis A.

To create a compact transducer for a speaker unit, it is required to make the stack of necessary components as low as possible. In electrodynamic transducers, several components are necessary such as coil(s), magnet(s), suspension(s), membrane(s), a frame to hold all components. In patent publication WO2020/160791 (of the same applicant as the present application), a cross shaped bellows suspension is disclosed. This bellows suspension shape has the benefit of allowing the air tight sealing suspension to stay on the inner perimeter of the membranes and spring-like suspension. A disadvantage of this cross-shape bellows structure is the suboptimal use of in-bounding-box surface area. To make use of the frontal surface of the driver as efficiently as possible, the orientation of the air tight sealing suspension is merged with the position of the drive units. The arrangement of drive units 3, 3' and suspensions 8, 8'; 9, 9' provides sufficient clearance for high excursion linear membrane movement without risk of collisions of internal components of the speaker unit 1.

In the embodiment described with reference to the drawings, the driver static part 6, 6' is a magnet stack 6, 6' and the driver moving part 7, 7' is a voice coil 7, 7'. The voice coil 7, 7' is moving relative to the magnet stack 6, 6' which is fixedly attached to the speaker frame 4. In further embodiments, the drive unit 3 may be kinematic reversed, having a driver static part 6, 6' formed by a voice coil fixedly attached to the speaker frame 4, and a driver moving part 7, 7' formed by a magnet or a stack of magnets fixedly attached to an associated one of the opposing membranes 2, 2'.

In further embodiments, for each drive unit 3, 3' the driver moving part 7, 7' is positioned at a minimum drive unit distance $r_d$ from the main speaker axis A, and the sealing edge suspension 8, 8' has a ring shape with a smallest radius $r_{min}$ which is larger than the minimum drive unit distance $r_d$.

These dimensions are also shown in the top projection view of the speaker unit of FIG. 1, wherein the projections of internal components onto the major front surface of the speaker unit 1 are shown, the front membrane 2 and front sealing edge suspension 8 being visible, and the other components (magnet stack 6, 6', voice coil 7, 7' and spider arm suspension 9, 9') being projected thereon along a line in parallel to the major speaker axis A as shown in FIGS. 2A and 2B.

The embodiments can also be defined using a further feature, wherein the sealing edge suspension 8, 8' has a ring shape with a largest radius $r_{min}+d_s$, the associated driver static parts 6, 6' being positioned on a magnet radius $r_m$ from the main speaker axis A, wherein the largest radius $r_{min}+d_s$ is larger than the magnet radius $r_m$. This ensures the sealing edge suspension 8, 8' is overlapping the magnet stacks 6, 6' when viewed along the major speaker axis A.

Note that in the embodiments shown, the spider arm suspension 9, 9' has a widest diameter which is less than a maximum diameter $d_m$ of the drive unit 3, 3'. As a result of this, in the embodiments, the drive unit 3, 3' and its directly associated components (i.e. spider arm suspension 9, 9') has a circumference when viewed along the major speaker axis A with the diameter $r_m$ positioned at a minimum drive unit distance $r_d$. The diameter of the voice coil 7, 7' is determining the volume within speaker frame 4 which is free of any interfering components.

As an alternative, embodiments may also be formulated where the sealing edge suspension 8, 8' has a substantially ring shaped form, wherein a projection of the ring shaped form on the major front surface along a direction parallel to the main speaker axis A at least partially overlaps with projections of the associated drive units 3, 3' on the major front surface along a direction parallel to the main speaker axis A. This is illustrated most clearly in the projection view of FIG. 1.

As shown most clearly in the cross sectional views of FIGS. 2A and 2B, the sealing edge suspension 8, 8' has an arc shaped cross section in a further group of embodiments. An apex of the arc shaped cross section is positioned on an apex radius $r_a$ from the main speaker axis A, the associated driver static parts 6, 6' being positioned on a magnet radius $r_m$ from the main speaker axis A, the apex radius $r_a$ being larger than the magnet radius $r_m$.

In the speaker unit 1, the membranes 2, 2' are brought in motion by the drive units 3, 3'. The membranes 2, 2' need to move in a linear motion, therefore the spider arm suspensions 9, 9' and the sealing edge suspensions 8, 8' are attached to each membrane 2, 2'. The spider suspension 9, 9' is attached to the membrane 2, 2' and the voice coil 7, 7', and positioned underneath the voice coil 7, 7' (taking the outward excursion direction of membrane 2 as facing up). The sealing edge suspension 8, 8' is attached to the membrane 2, 2' at the periphery thereof, and positioned above the voice coil 7, 7'. To make the frontal face (major front surface) of the speaker unit 1 as compact as possible, the middle of the sealing edge suspension 8, 8', i.e. the apex of the arc shaped cross section is situated above the drive unit 3, 3'. The apex is the middle of the arc shaped cross section, in other words equal to the outer diameter of the bending part (arc shaped cross section) of the sealing edge suspension 8, 8', plus the inner diameter of the bending part, divided by two. As a result, when the membrane 2, 2' is in motion, the arc shaped cross section of the sealing edge suspension 8, 8' will bend over the magnet stack 6, 6' of the drive unit 3, 3'(as the voice coil 7, 7' is moving inward in the speaker frame 4. Because of the positioning of the sealing edge suspension 8, 8' and the drive unit 3, 3, the membrane 2, 2' is able to move within the speaker frame 4 without collisions with other components of the speaker unit 1.

In an even further embodiment, a projection on the major front surface of the spider arm suspension 9, 9' (see top projection view of FIG. 1) in a direction parallel to the main speaker axis A is within a projection on the major front surface of the associated driver moving part 7, 7'. This ensures that the other membrane 2', 2 associated with the spider arm suspension 9, 9' cannot be blocked by this component. As is shown in the exemplary embodiments of FIG. 1-3B, the spider arm suspension element 9, 9 is a flexible material element, with a first attachment part 9*a* attached to the associated voice coil 7, 7', and a second attachment part 9*b* attached to the speaker frame 4 opposite to the associated membrane 2, 2'. In between the first and second attachment parts 9*a*, 9*b*, e.g. two connection members 9*c* and a semi-circular bending member 9*d* are provided, allowing the spider arm suspension element 9, 9' to have a variable height while all components thereof stay within the maximum diameter $d_m$ of the associated drive element 3, 3'.

As discussed above, each membrane 2, 2' comprises membrane connection elements 2*a*, 2*a'* connecting the membrane 2, 2' to an associated driver moving part 7, 7'. The connection element 2*a*, 2*a'* may form an integrated element of each membrane 2, 2', or alternatively, it may be a separate element connected to the voice coil 7, 7' and the membrane 2, 2'. In order to ensure proper operation, each membrane connection element 2*a*, 2*a'* is positioned at a predetermined distance from the other one of the opposing membranes 2, 2' when the opposing membranes 2, 2' are at a minimum distance ($a_{min}$) of each other during operation (see FIGS. 2B and 3B). This ensures that even at the minimum distance $a_{min}$ the connection element 2*a*, 2*a'* is not in contact with the (back side of) membrane 2, 2'.

In the exemplary embodiments shown in and described with reference to FIG. 1-3B, each membrane 2, 2' is connected to two associated drive units 3, 3' positioned at opposite sides of the membrane 2, 2'. In even further embodiments, the at least two drive units 3, 3' for each of the two opposing membranes 2, 2' are positioned equidistantly from the speaker main axis A. This allows an effective use of the entire membrane 2, 2' surface with as little as possible non-linearities being introduced. The drive units 3, 3' positioned at an edge of the membrane 2, 2', can also be equiangular positioned, i.e. at 180 degrees (two drive units), 120 degrees (three drive units), 90 degrees (four drive units). Similar features as described above for exemplary embodiments having two drive units 3, 3' for each membrane 3, 3' can also be applied for a higher number of drive units 3, 3' per membrane 2, 2'.

In even further embodiments, the two opposing membranes 2, 2' each comprise a frontal sound producing surface with a conical surface, a frusto-conical surface, or a flat surface. In the embodiments shown in the figures and discussed above, the membranes 2, 2' have a frusto-conical shape, with a flat surface in the middle of the conus shape. The other surface shapes are also possible to be implemented, with the proper adaption of possibly interfering components of the speaker unit 1, as discussed above for all other exemplary embodiments.

The present invention has been described above with reference to a number of exemplary embodiments as shown in the drawings. Modifications and alternative implementations of some parts or elements are possible, and are included in the scope of protection as defined in the appended claims.

The invention claimed is:

1. A speaker unit comprising a speaker frame with a major front surface and a major back surface, two opposing membranes arranged in the major front surface and the major back surface, respectively, each being arranged to move along a main speaker axis (A), at least two drive units for each of the two opposing membranes, each drive unit comprising a driver static part and a driver moving part, the driver moving part being fixedly connected to the associated one of the two opposing membranes, wherein each of the two opposing membranes are provided with a sealing edge suspension connected to a perimeter of the associated membrane and to the major front surface and major back surface, respectively, further comprising, for each driver moving part, a spider arm suspension connected on one side to the associated driver moving part and on another side to the speaker frame for suspending the driver moving part to the speaker frame in a flexible manner, wherein the sealing edge suspension is at least partially positioned above the associated drive units when viewed in a direction parallel to the main speaker axis (A)

wherein each spider arm suspension comprises a first connection part connecting to the associated driver moving part, a second connection part connected to the frame and at least one connection member and a semicircular bending member between the first and second connection parts, and wherein the semicircular bending member extends around the driver static part.

2. The speaker unit according to claim 1, wherein, for each drive unit, the driver moving part is positioned at a minimum drive unit distance ($r_d$) from the main speaker axis (A), and the sealing edge suspension has a ring shape with a smallest radius ($r_{min}$) which is larger than the minimum drive unit distance ($r_d$).

3. The speaker unit according to claim 2, wherein the sealing edge suspension has a ring shape with a largest radius ($r_{min}+d_s$), the associated driver static parts being positioned on a magnet radius ($r_m$) from the main speaker axis (A), wherein the largest radius ($r_{min}+d_s$) is larger than the magnet radius ($r_m$).

4. The speaker unit according to claim 1, wherein the spider arm suspension has a widest diameter which is less than a maximum diameter ($d_m$) of the drive unit.

5. The speaker unit according to claim 1, wherein the sealing edge suspension has a substantially ring shaped form, wherein a projection of the ring shaped form on the major front surface along a direction parallel to the main speaker axis (A) at least partially overlaps with projections of the associated drive units on the major front surface along a direction parallel to the main speaker axis (A).

6. The speaker unit according to claim 1, wherein the sealing edge suspension has an arc shaped cross section, an apex of the arc shaped cross section being positioned on an apex radius ($r_a$) from the main speaker axis (A), the associated driver static parts being positioned on a magnet radius ($r_m$) from the main speaker axis (A), the apex radius ($r_a$) being larger than the magnet radius ($r_m$).

7. The speaker unit according to claim 1, wherein a projection on the major front surface of the spider arm suspension in a direction parallel to the main speaker axis (A) is within a projection on the major front surface of the associated driver moving part.

8. The speaker unit according to claim 1, wherein each membrane comprises membrane connection elements connecting the membrane to an associated driver moving part.

9. The speaker unit according to claim 8, wherein each membrane connection element is positioned at a predetermined distance from the other one of the opposing membranes when the opposing membranes are at a minimum distance ($a_{min}$) of each other during operation.

10. The speaker unit according to claim 1, wherein the driver static part is a magnet stack and the driver moving part is a voice coil.

11. The speaker unit according to claim 1, wherein the at least two drive units for each of the two opposing membranes are positioned equidistantly from the speaker main axis (A).

12. The speaker unit according to claim 1, wherein the two opposing membranes each comprise a frontal sound producing surface with a conical surface, or a frusto-conical surface.

13. The speaker unit according to claim 1, wherein at least one connection member extends in the direction parallel to the main speaker axis (A).

14. The speaker unit according to claim 1, wherein each spider suspension is positioned underneath the voice coil taking the outward excursion direction of the membrane as facing up.

15. A speaker unit comprising:

a speaker frame with first and second opposing sides;

first and second membranes arranged in the first and second sides, respectively, the first and second membranes moveable along a main speaker axis (A); and for each of the first and second membranes:

a plurality of drive units comprising a driver static part and a driver moving part, each driver moving part fixedly connected to the respective membrane and with a spider arm suspension connected on one side to the respective driver moving part and on the other side to the speaker frame;

wherein each spider arm suspension comprises a first connection part connecting to the associated driver moving part, a second connection part connected to the frame and at least one connection member and a semi-circular bending member between the first and second connection parts, wherein the semi-circular bending member extends around the driver static part;

a sealing edge suspension connected to the perimeter of the respective membrane and to the respective side and positioned at least partially adjacent to the respective drive unit.

16. The speaker unit of claim 15, wherein, for each drive unit, the driver moving part is positioned at a minimum drive unit distance ($r_d$) from the main speaker axis (A), and the sealing edge suspension has a ring shape with a smallest radius ($r_m$ n) which is larger than the minimum drive unit distance ($r_d$).

17. The speaker unit according to claim 16, wherein the sealing edge suspension has a ring shape with a largest radius ($r_{min}+d_s$), the associated driver static parts being positioned on a magnet radius ($r_m$) from the main speaker axis (A), wherein the largest radius ($r_{min}+d_s$) is larger than the magnet radius ($r_m$).

18. The speaker unit according to claim 15, wherein the sealing edge suspension has a substantially ring shaped form, wherein a projection of the ring shaped form on the first side along a direction parallel to the main speaker axis (A) at least partially overlaps with projections of the associated drive units on the first side along a direction parallel to the main speaker axis (A).

19. The speaker unit according to claim 15, wherein a projection on the first side of the spider arm suspension in a direction parallel to the main speaker axis (A) is within a projection on the first side of the associated driver moving part.

* * * * *